US006824078B2

(12) United States Patent
Reizian

(10) Patent No.: US 6,824,078 B2
(45) Date of Patent: Nov. 30, 2004

(54) SYSTEM FOR DELIVERING NITROGEN-PROPELLED FABRIC PAINT

(75) Inventor: David H. Reizian, Lakeville, MA (US)

(73) Assignee: Enviro-Pac International, LLC, Lincoln, RI (US)

( * ) Notice: Subject to any disclaimer, the term of this patent is extended or adjusted under 35 U.S.C. 154(b) by 0 days.

(21) Appl. No.: 10/425,475

(22) Filed: Apr. 29, 2003

(65) Prior Publication Data

US 2003/0205633 A1 Nov. 6, 2003

Related U.S. Application Data

(62) Division of application No. 09/824,417, filed on Apr. 2, 2001, now Pat. No. 6,616,975.

(51) Int. Cl.[7] ..... B05B 7/32
(52) U.S. Cl. ..... 239/337; 239/601; 222/402.15
(58) Field of Search ..... 239/337, 599, 239/601; 222/402.15, 402.13

(56) References Cited

U.S. PATENT DOCUMENTS 1,899,222 A * 2/1933 Werder ..... 239/337
4,453,650 A * 6/1984 Witte et al. ..... 239/573
5,552,189 A * 9/1996 Shaffer ..... 427/421

* cited by examiner

*Primary Examiner*—Dinh Q. Nguyen
(74) *Attorney, Agent, or Firm*—Burns & Levinson LLP; Frederick C. Williams; Yan Lan

(57) ABSTRACT

A fabric paint delivery system includes a container storing fabric paint under nitrogen pressure, the container having an opening for discharge of the paint therethrough; a valve operative for receiving the paint from the opening; a trigger assembly having a nozzle operative for discharging the paint received from the container through the valve, the trigger assembly having a trigger for opening and closing the valve to selectively discharge the paint from an opening of the nozzle as a mist in a spray cone; wherein the trigger is operable by pulling the trigger towards the container using one's index finger for opening the valve and for closing the valve by releasing the trigger.

10 Claims, 3 Drawing Sheets

TWIST

FLAT

FOLD

RIPPLE

SYSTEM FOR DELIVERING NITROGEN-PROPELLED FABRIC PAINT

The present application is a divisional application of U.S. patent application Ser. No. 09/824,417, filed Apr. 2, 2001, now U.S. Pat. No. 6,616,975.

BACKGROUND OF THE INVENTION

The invention relates to paint delivery systems and methods, and more particularly to a paint delivery system and method for delivering nitrogen-propelled fabric paint.

Current paint delivery systems and methods include systems of the type sold by Krylon® ("Krylon®-type systems"), air brush systems and dimensional paint systems. Krylon®-type systems typically include solvent-based paint and/or paint that is propelled by carbon dioxide. Solvent-based paint is generally toxic and can not easily be washed off skin, walls, and other surfaces without using alcohol or other harsh cleaners. Solvent-based paint also tends to exhibit dangerous fumes and can be classified as an inhalant. Further, solvent-based paint is flammable. For these reasons, the sale of Krylon®-type systems to children under 18 in the United States is restricted. Solvent-based paint is generally used for hard surfaces, rather than soft surfaces such as fabric. Therefore, solvent-based paint is not particularly useful for many applications in the crafts industry.

In addition, Krylon®-type systems are characterized by a spray button on the top of the container that when depressed releases the pressurized paint in the container. These spray buttons create strain because the artist grips the container around its cylindrical axis while pressing the button with a force along the cylindrical axis. More specifically, the thumb and second finger of the artist's hand (with only minimal assistance from the third and fourth fingers) grips the pain can around its cylindrical axis. At the same time, the tip of the index finger alone is required to press down on the button, along the cylindrical axis, while the paint is being released. The fact that the griping direction is perpendicular to the triggering direction causes strain and therefore fatigue. Further in Krylon®-type systems, the depression of the button abruptly releases the paint. The abruptness of the delivery and the high viscosity of the solvent-based paint causes clotting and spitting to occur, compromising the uniformity of the spray and the predictability of the painting results. These features also prevent the system from being used in close proximity to the article to be painted.

Therefore, while Krylon®-type systems are acceptable for use in commercial and work applications, where the proper amount of care can be taken to avoid and remedy problems associated with toxicity, combustion, and inhalation, they are unsuitable for recreational projects such as craft-making, and especially unsuitable for use with and by children. They are also unsuitable for artistic projects because the clotting and spitting do not provide sufficient control over the spray, and the predictability of the spray, to allow the craftsperson to artistically apply the paint.

Air brush systems also use carbon dioxide for holding the paint under pressure in the container, and therefore share many of the limitations recited above with regard to the Krylon®-type systems, including toxicity, combustion, and inhalation problems. In addition, while Krylon®-type systems tend to be relatively inexpensive, air brush systems require or at least recommend the purchase of large paint tanks and several brush tips, and can be significantly more expensive than Krylon®-type systems.

Dimensional paint delivery systems are suited to the crafts industry for certain applications, however, they also have several limitations. The paint is stored in tubes, and is delivered primarily by squeezing the tube or otherwise urging the paint through an opening of the tube. The paint is thick and heavy, and therefore must be applied slowly, and cannot be applied to create detailed designs. Nor can it be applied to create two-dimensional designs, because when it dries on the fabric, it is raised from the fabric to create a three-dimensional design even when simple designs are created. The dried paint is therefore rough to the touch, and cannot be used if the fabric to which it is applied will be treated roughly or washed without care. Articles of clothing to which the dried dimensional paint is applied are typically uncomfortable to wear. Stencils cannot be used, because the paint is too thick and the paint is not delivered in a spray. Of course, in some craft projects such features of dimensional paint systems are advantages, but for other craft projects, the dimensional paint systems cannot achieve the desired result.

Accordingly, there is a need to provide a fabric paint delivery system and method that overcomes these and other limitations.

SUMMARY OF THE INVENTION

In an embodiment, the invention provides a fabric paint delivery system including a container storing fabric paint under nitrogen pressure, the container having an opening for discharge of the paint therethrough; a valve operative for receiving the paint from the opening; a trigger assembly having a nozzle operative for discharging the paint received from the container through the valve, the trigger assembly having a trigger for opening and closing the valve to selectively discharge the paint from an opening of the nozzle as a mist in a spray cone; wherein the trigger is operable by pulling the trigger towards the container using one's index finger for opening the valve and for closing the valve by releasing the trigger.

In one aspect of the invention, the container has a longitudinal axis and the trigger is movable in a direction perpendicular to the axis.

In another aspect of the invention, the paint comprises an acrylic polymer. Preferably, the paint is water-soluble. Also preferably, the paint comprises non-flammable and non-toxic components.

In another aspect, paint has a viscosity of between 2500 centipoises and 3500 centipoises, and preferably has a viscosity of 2800 centipoises.

In another aspect of the invention, the container holds up to 6 ounces of the paint.

In another aspect of the invention, the pressure under which the paint is stored in the container is between 130 psi and 140 psi.

In another aspect of the invention, the spray cone has a diameter between 5 and 7 inches at between 4 and 6 inches from the opening of the nozzle of the trigger assembly. Preferably, the spray cone has a diameter of 6 inches at 5 inches from the opening of the nozzle of the trigger assembly.

In another embodiment, the invention provides a method for delivering fabric paint onto an article of fabric, including exposing at least one area of the article that is to be painted; directing an opening of a nozzle toward the area, the nozzle being adapted to receive paint from a valve and deliver the paint from the opening of the nozzle, the valve being in fluid communication with a container storing fabric paint under nitrogen pressure; engaging a trigger to open the valve to release the paint and close the valve to prevent the release of the paint; and delivering the paint from the opening of the nozzle as a mist in a spray cone onto the area of the article.

In an aspect, the method includes gripping the container by a person's hand and simultaneously engaging the trigger to open the valve by the person's index finger pulling the trigger toward the container, and allowing the trigger to close the valve by the person's index finger releasing the trigger. Preferably, the method includes pulling the trigger perpendicular to a longitudinal axis of the container.

In another aspect of the method, exposing the area comprises manipulating the article. Preferably, manipulating the article is selected from the group consisting of wrinkling the article, twisting the article, laying the article flat, folding the article, and rippling the article.

In another aspect of the method, exposing the area comprises using a device to expose the area. Preferably, exposing the area is selected from the group consisting of compressing at least a portion of the article using a flexible member, compressing at least a portion of the article using a rigid member, and covering at least a portion of the article with a stencil that leaves the area exposed. Also preferably, the stencil is selected from the group consisting of a letter stencil, a word stencil, and an image stencil.

In another aspect, the method includes maintaining the opening of the nozzle at a distance of between 4 and 6 inches from the area.

In another aspect, the method includes moving the opening of the nozzle in a motion proximal to the area as the paint is released. Preferably, the method includes varying at least one of the speed of the motion and the proximity of the opening of the nozzle to the area. Also preferably, the motion is circular.

In another aspect of the method, the paint comprises an acrylic polymer. Preferably, the paint is water-soluble. Also preferably, the paint comprises non-flammable and nontoxic components.

In another aspect of the method, the paint has a viscosity of between 2500 centipoises and 3500 centipoises, and preferably a viscosity of 2800 centipoises.

In another aspect of the method, the container holds up to 6 ounces of the paint.

In another aspect, the method includes delivering the paint at a pressure between 130 psi and 140 psi.

In another aspect, the method includes delivering the paint in a spray cone having a diameter between 5 and 7 inches at between 4 and 6 inches from the opening of the nozzle.

In another aspect, the method includes delivering the paint in a spray cone having a diameter of 6 inches at 5 inches from the opening of the nozzle.

DETAILED DESCRIPTION

Figure 1:
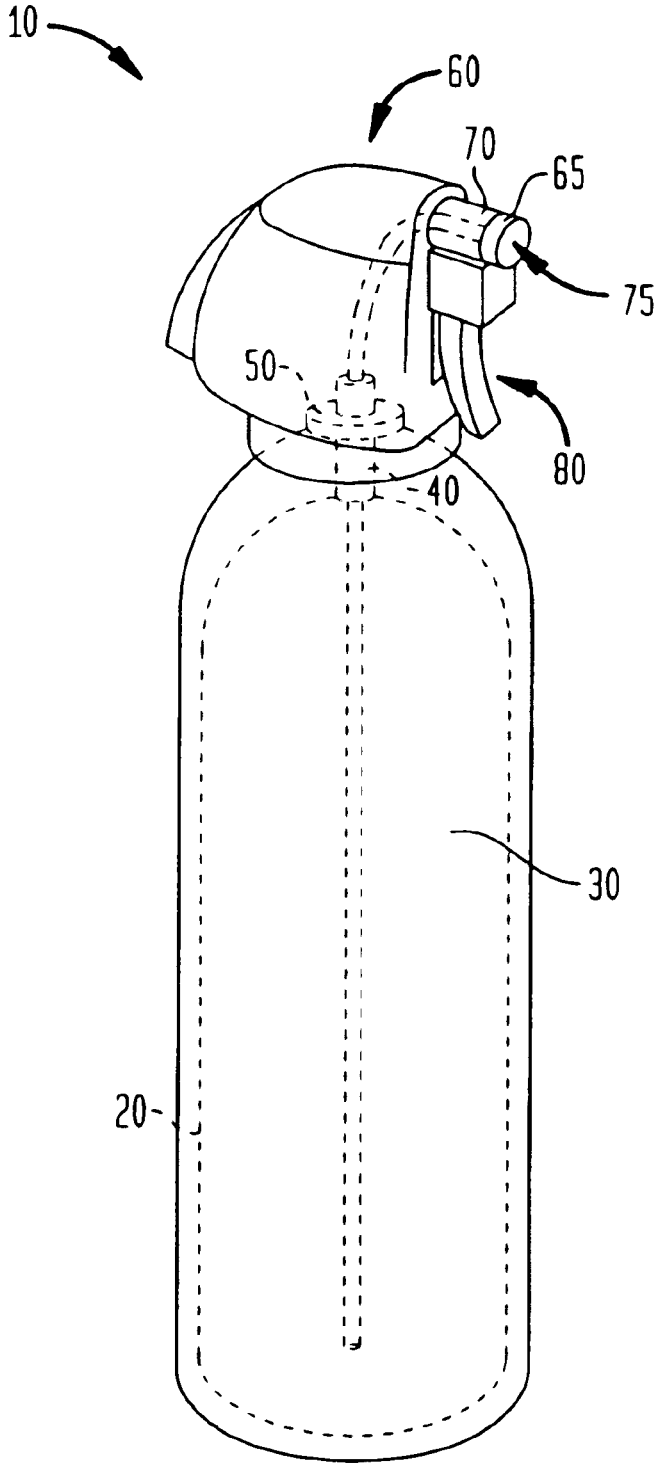
FIG. 1 is a side view of an embodiment of a fabric paint delivery system of the invention, showing certain components in phantom.

In an embodiment, illustrated in FIG. 1, the invention provides a paint delivery system 10 including a container 20 storing paint 30 under pressure. The system 10 further includes a valve 40 adapted to receive the paint 30 from an opening 50 of the container 20. The system further includes a trigger assembly 60 having a nozzle 70 operative for discharging the paint received from the container 20 through the valve 40, the trigger assembly 60 having a trigger 80 for opening and closing the valve 40 to selectively discharge the paint 30 from the nozzle 70.

The paint 30 is fabric paint and is held under pressure in the container 20 with nitrogen. The trigger assembly 60 is adapted to deliver the paint 30 from an opening 75 of the nozzle 70 of the trigger assembly 60 as a mist in a solid spray cone. The container 20 is a cylindrical container that can be gripped by a person's hand, and when the container 20 is so gripped, the trigger 80 can be engaged to open the valve 40 by the person's index finger pulling the trigger 80 toward the container 20, and the trigger 80 can be allowed to close the valve 40 by the person's index finger releasing the trigger 80.

In one aspect, the paint 30 is an acrylic polymer system that includes an acrylic polymer as a major component. The paint 30 can also include propylene glycol as a major component. Preferably, the paint 30 can be classified as water soluble, non-combustible, non-flammable, and non-toxic. Also preferably, the paint 30 will not be classified as a dangerous inhalant. Also preferably, the paint 30 has a viscosity of between 2500 centipoises and 3500 centipoises. It should be understood that this range encompasses the limits of the stated range as well as each increment in between the limits as if recited specifically herein. Even more preferably, the paint 30 has a viscosity of 2800 centipoises. While many different paints can be used with the invention, a suitable paint is available as "800 Series" paint from RBC Industries, Inc. in Warwick, R.I.

An acrylic polymer system is preferable for use with the invention because it is suitable for use with the container 20, valve 40, and trigger assembly 60 of the invention to provide the benefits of the invention described herein. More specifically, the low viscosity of the paint 30 enables the paint 30 to pass through the valve 40 and from the opening 75 of the nozzle 70 of the trigger assembly 60 at a high speed as a mist, as described in greater detail below. The advantages of the mist and spray cone achieved by the invention, especially for use in the crafts industry, are described below.

Also, the water soluble, non-combustible, nonflammable, and non-toxic natures of the paint 30 make it ideal for use by children. The paint 30 can be washed off the skin or a wall easily with water. By contrast, solvent-based paints of the prior art must be washed off skin and walls with alcohol or other harsh cleaners. The fact that the paint 30 will easily wash off walls allows the system to be made available for sale to children under the age of 18 without restriction in the United States, in that it is not useful for creating graffiti on walls. The fact that the paint 30 cannot be classified as a dangerous inhalant also allows the system to be made available for sale to children under the age of 18 without restriction in the United States. These features are particularly useful in the crafts industry where adults and children alike are using or exposed to paint for a variety of projects, and are often making a mess while creating such projects. The easy clean-up provided by the invention makes projects more enjoyable. The fact that the paint 30 of the invention is non-toxic and is not a dangerous inhalant increases the safety of the project and peace of mind of the parents or guardians of the children.

In addition, the paint 30 will not combust or catch fire if it is near a flame. This feature is enhanced in that the paint 30 is held under pressure by nitrogen. By contrast, solvent-based paints of the prior art are combustible and flammable, aspects that are aggravated inasmuch as the paints are typically held under pressure using carbon dioxide. These features are particularly useful in the crafts industry where open flames are used for some projects, and the invention may be used nearby such flames for painting. The invention therefore increases the safety of such projects.

Further, the paint 30 has a dye-like effect on fabric, such that once it dries, it is soft to the touch. This has additional advantages in that special care does not need to be taken to wash fabric painted using the invention. By contrast, dimensional paint of prior art systems is hard to the touch once it dries on fabric, and therefore is uncomfortable to wear and uncomfortable to touch. Moreover, once a fabric is painted with these prior art paint delivery systems, it must be washed carefully to prevent cracking and other damage to the design. These features are particularly useful in the crafts industry where as many options for creating new designs on fabric for a variety of applications are desirable. The invention provides more options by enabling the creation of colorful soft designs on fabric that is intended to be handled or washed roughly.

In another aspect, the container 20 is adapted to hold up to 6 ounces of the paint 30. Preferably, the container 20 is aluminum. While any container can be used, a suitable container is available from Hunting Custom Packaging in Lincoln, R.I. Further, the container 20 can be filled with paint and pressurized with nitrogen by Hunting Custom Packaging in Lincoln, R.I. The fact that the container 20 is adapted to hold up to 6 ounces of the paint 30 allows the system to be made available for sale to children under the age of 18 without restriction in the United States. This feature is particularly useful in the crafts industry where children are typically purchasing and operating paint delivery systems while working on projects.

It should be understood that the safety and ease of use features described above are advantages that can be taken in conjunction with any of the other methods and benefits described herein, to provide a wide range of creative possibilities which has not previously been achieved in the art, but which is provided as disclosed herein by the invention.

In another aspect, the pressure under which the paint 30 is held is less than 200 psi, and preferably between 130 and 140 psi. It should be understood that this range encompasses the limits of the stated range as well as each increment in between the limits as if recited specifically herein. Preferably, the valve 40 restricts the flow of the paint 30 from the container 20 to a pre-determined flow rate, designed to work in conjunction with the low viscosity of the paint 30, the pressure in the container 20, and the construction of the trigger assembly 60, to release from the container 20 small amounts of the paint 30 at a high speed when the valve 40 is opened. While many valves can be used to achieve this result, a suitable valve is available as Part No. 1020300-3 from Precision Valve Corporation in Yonkers, N.Y. The range of pressures and construction of the valve 40 are chosen for the invention because, in conjunction with the trigger assembly 60, as described immediately below, these features help to achieve the desired misting.

As noted above, the trigger assembly 60 of the invention is adapted to deliver the paint 30 from the opening 75 of the nozzle 70 as a mist in a solid spray cone. In this aspect, the trigger assembly 60 of the invention can include an insert 65 at the opening 75. of the nozzle 70 that causes the paint 30 to be atomized, as it leaves the opening 75. Preferably, the spray cone has a diameter between 5 and 7 inches at between 4 and 6 inches from the opening 75 of the nozzle 70. It should be understood that each of these ranges encompasses the limits of the stated range as well as each increment in between the limits as if recited specifically herein. Even more preferably, the spray cone has a diameter of 6 inches at 5 inches from the opening 75 of the nozzle 70. The insert 65 is designed to achieve these results when receiving the paint 30 in a small amount at a high speed (achieved by the low viscosity of the paint 30, the pressure in the container 20, and the constructions of the valve 40 and the trigger assembly 60, as described herein). While many trigger assemblies can be used to achieve this result, a suitable trigger assembly includes a shroud assembly that is available as Part No. 10-4501-50 from Precision Valve Corporation in Yonkers, N.Y., and an insert available as Part No. 11-8141-05 from Precision Valve Corporation in Yonkers, N.Y.

The misting is a benefit achieved by the invention. Because the paint 30 is delivered in a fine mist, the artist has greater control over the uniformity and predictability of the paint delivery and the paint coverage. For example, the fine mist that results does not include lumps, spatterings, or other non-uniform portions. This makes the paint delivery and paint coverage predictable, so that the artist can exercise full creative license without worrying whether the design will be unexpectedly compromised by an unwanted lump or spattering, and without having to compensate or otherwise alter the design in case such a lump or spattering is delivered from the opening 75 of the nozzle 70. The added benefit of the spray cone having the stated dimensions allows the artist to work close to the fabric while still achieving wide coverage. These features are particularly useful in the crafts industry where workstations are typically in close proximity to one another and it may be desirable to cover large areas of the fabric quickly. Of course, if it is desirable to cover smaller areas of the fabric, various methods of the invention can be used, as described below, to block out certain areas of the fabric by using stencils, or folding or otherwise manipulating and/or arranging the fabric. The ability to maintain such control over designs on fabrics in the crafts industry, the ability to work in close proximity to the fabric if necessary, and the ability to cover small or large areas of the fabric quickly, have not previously been achieved in the art, but are provided as disclosed herein by the invention.

In addition, because the paint 30 is delivered in a fine mist, the artist has greater control over the shading of the particular color. For example, the artist can cover the exposed area in a very thin layer of the paint 30 if desired, by minimizing the time of paint delivery to the exposed area, or in a thicker layer of the paint 30 if desired, by increasing the time of paint delivery to the exposed area. Thus, the artist can create artwork on the fabric through which the original color of the fabric can be seen, to any desired degree, for a translucent effect of any desired degree. Or, for example, the artist can cover the exposed area in a thin layer of the paint 30 to create artwork on the fabric that includes a light shade of the paint color. Or, for example, the artist can cover the exposed area in a thicker layer of the paint 30 to create artwork on the fabric that includes a darker shade of the paint color. Because the mist is a fine mist, many shades of each color can be achieved, with a very slight shade difference between each shade and the next. With such a large number of incremental shades at his disposal, the artist can create with the invention a wide variety of designs that could not previously be achieved in the art.

In addition, because the paint 30 is delivered in a fine mist, the artist has greater control over the mixing of colors.

For example, the artist can cover the exposed area with any desired shade of a particular color, and then apply paint of a different color to the area to create a mixed color. Not only can any number of available colors be mixed to create unique and previously unattainable designs on fabric, but each of the colors in the mix can be applied in any desired shade, further expanding the range of creative possibilities offered by the invention. Even if, after mixing a third color on top of a second color, more of the second color is desired, an additional fourth layer, comprising as little as a very thin layer of the second color, can be applied on top of the third color, to achieve the exact mixed desired by the artist.

It should be understood that the uniformity of the paint delivery and the paint coverage, and the fine shading and mixing described above, are advantages that can be taken in conjunction with any of the other methods and benefits described herein, to provide a wide range of creative possibilities which has not previously been achieved in the art, but which is provided as disclosed herein by the invention.

As noted above, the trigger 80 is for opening and closing the valve 40 to selectively release the paint 30, and the container 20 is a cylindrical container that can be gripped by a person's hand. When the container 20 is so gripped, the trigger 80 can be engaged to open the valve 40 by the person's index finger pulling the trigger 80 toward the container 20, and the trigger 80 can be allowed to close the valve 40 by the person's index finger releasing the trigger 80. These features of the invention provide significant ergonomic benefits, described below, that are particularly useful in the crafts industry. While many trigger designs can be used to achieve these results, a suitable trigger is available as Part No. 10-4090-00 from Precision Valve Corporation in Yonkers, N.Y.

First, the action of pulling the trigger 80 repeatedly over time causes less fatigue than prior art paint delivery systems. Specifically, spray buttons of the type used on Krylon®-type systems create strain because the artist grips the container around its cylindrical axis while pressing the button with a force along the cylindrical axis. More specifically, the thumb and second finger of the artist's hand (with only minimal assistance from the third and fourth fingers) grip the paint can around its cylindrical axis. At the same time, the tip of the index finger alone is required to press down on the button, along the cylindrical axis, while the paint is being released. By contrast, the trigger 80 of the invention allows the artist to grip the paint can with his thumb and second through fourth fingers around its cylindrical axis, and use his index finger to squeeze the trigger 80 around the cylindrical axis, while the paint 30 is being released. The fact that the gripping direction is parallel to the triggering direction in the system of the invention creates less strain than in the prior art systems, where the gripping direction is perpendicular to the triggering direction.

Second, the manner in which the trigger 80 is pulled provides the artist with greater control over the application of the paint 30. Specifically, when an artist uses spray buttons of the type used on Krylon®-type systems as described above, his index finger can easily slip off the button, especially as the finger becomes fatigued over time. By contrast, not only is there less of a chance that the index finger of an artist using the invention will slip off the trigger 80 because less fatigue is experienced, but the fact that a greater portion of the index finger engages the trigger 80 also prevents the finger from slipping off the trigger 80. A design can easily be compromised if the paint delivery is suddenly and unexpectedly terminated in the middle of an application.

Figure 2:
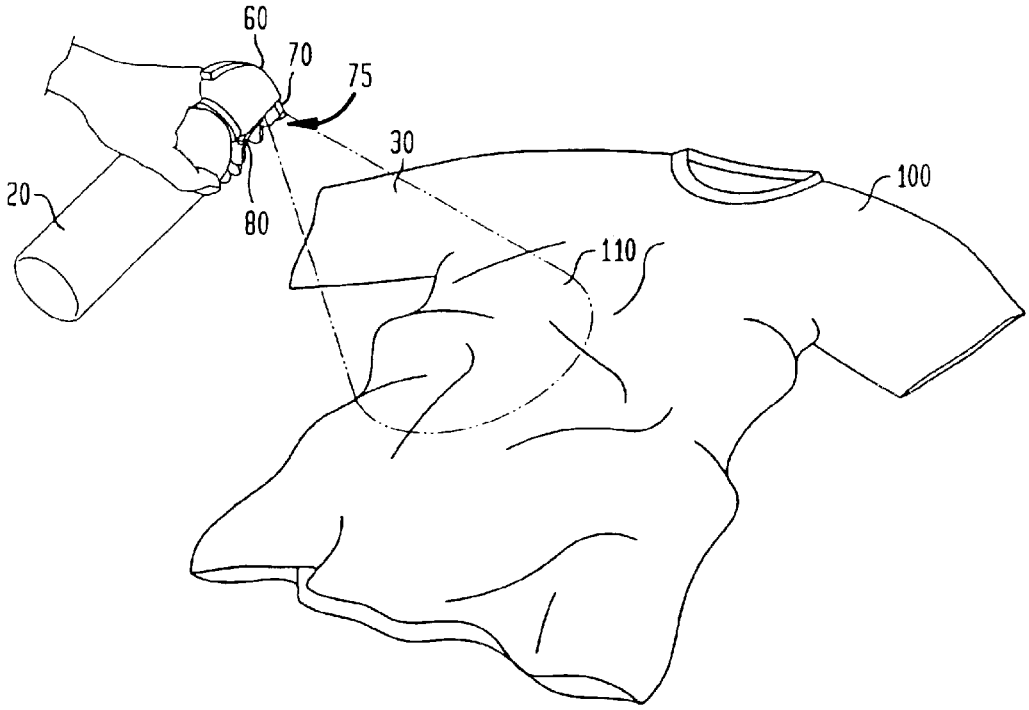
FIG. 2 is an illustration of an embodiment of a paint delivery method of the invention using the system shown in FIG. 1.
Figure 3A:
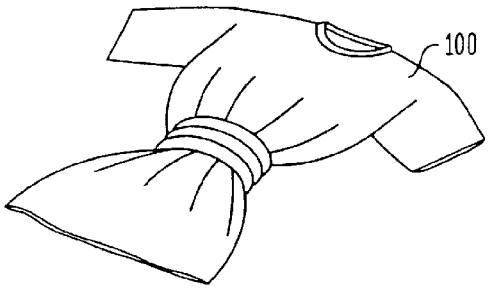
FIGS. 3*a–d* are illustrations of exemplary ways to manipulate an article that is to be painted according to a method of the invention.
Figure 3B:
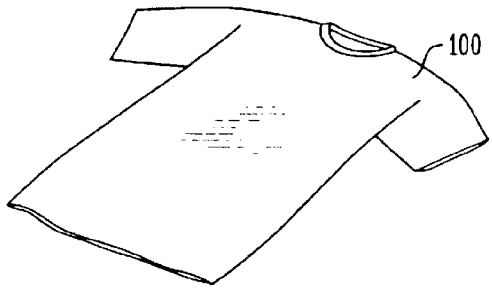
Figure 3C:
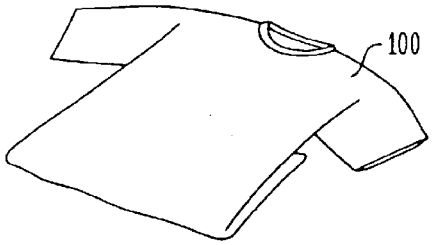
Figure 3D:
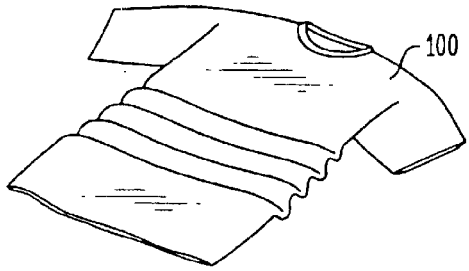

In operation, and further with regard to FIG. 2, the system 10 can be used in a method of the invention for delivering paint 30 onto an article 100 of fabric The method includes exposing at least one area 110 of the article 100 that is to be painted and directing an opening 75 of a nozzle 70 of a trigger assembly 60 toward the area 110. The trigger assembly 60 is adapted to receive paint 30 from a valve 40 and deliver the paint 30 from the opening 75 of the nozzle 70. The valve 40 is adapted to receive the paint 30 from an opening 50 of a container 20. The container 20 holds the paint 30 under pressure. The method further includes engaging a trigger 80 of the trigger assembly 60 to open the valve 40 to release the paint 30 and close the valve 40 to prevent the release. The paint 30 is fabric paint and is held under pressure in the container 20 with nitrogen. The trigger assembly 60 is adapted to deliver the paint 30 from the opening 75 of the nozzle 70 as a mist in a solid spray cone 120.

In one aspect of the method of the invention, as discussed in greater detail above with regard to the system of the invention, the container 20 is a cylindrical container that can be gripped by a person's hand, and when the container 20 is so gripped, the trigger 80 can be engaged to open the valve 40 by the person's index finger pulling the trigger 80 toward the container 20, and the trigger 80 can be allowed to close the valve 40 by the person's index finger releasing the trigger 80. As discussed above, this aspect of the method provides ergonomic benefits not available in prior art paint delivery systems.

In another aspect of the method of the invention, illustrated in FIGS. 2 and 3*a*–3*d*, exposing the area 110 includes at least one of wrinkling the article 100, twisting the article 100, folding the article 100, laying the article 100 flat, and rippling the article 100. Different designs can be achieved by these methods, and by compounding these methods. It should be understood that any fabric article 100 can be used according to the method of the invention, including but not limited to t-shirts, sweatshirts, canvas sneakers, pillows, curtains, hats, pants, and lampshades. The illustrated example shows a t-shirt 100 as the article 100, and a wrinkled portion 110 of the t-shirt as the area 110. When the t-shirt is wrinkled, only certain portions of the t-shirt are exposed for painting, while other portions are not exposed because they are hidden in the crevasses of the wrinkles. After the paint 30 is delivered, un-wrinkling the t-shirt reveals a pattern. Typically, the wrinkling causes a random pattern to be obtained, but purposed wrinkling can also be accomplished according to the method of the invention to achieve specific desired results.

Similarly, other types of manipulation, including but not limited to twisting, folding, laying the article 100 flat, and/or rippling the article 100, employ the same principle to achieve a variety of results. Folding the article 100 exposes only those portions of the article 100 not tucked under other portions. This can be used to create blocks or other shapes of color or colors. Twisting the article 100 before applying the paint 30 can be accomplished to create spiral patterns and parallel line patterns. Rippling the article 100 before applying the paint 30 can be accomplished to create stripe patterns, with straight and/or curved stripes. Laying the article 100 flat before applying the paint 30 can be accomplished to uniformly change the color of the article 100, or only certain potions of the article 100, as desired, according to the movement of the opening 75 of the nozzle 70.

It should be understood that the types of manipulation provided here are merely examples, and the invention encompasses any manner of manipulation. After the article 100 is manipulated as desired, and the paint 30 is applied to the exposed areas 110, and the manipulation is then reversed, the pattern achieved according to the manipulation is revealed. This aspect of the method of the invention can be used to achieve painted fabric results that were not previously possible in the crafts industry.

In another aspect of the method of the invention, exposing the area 110 includes using a device to expose the area 110. For example, exposing the area 110 can include compressing at least a portion of the article 100 using a flexible member. While any suitable flexible member can be used, some suitable flexible members include elastic members (e.g., rubber bands and/or bungee cords), string, rope, cords and straps. For example, the article 100 can be squeezed and a rubber band placed, or string tied, around the squeezed portion to maintain the compression, prior to the delivery of the paint 30. After the delivery of the paint 30, and once the rubber band or string is removed and the compression is released, a pattern is revealed because the compression prevent some portions of the article 100 from being exposed to the paint 30.

For another example, exposing the area 110 can include compressing at least a portion of the article 100 using a rigid member. While any suitable rigid member can be used, some suitable rigid members include clamps, clips, rods, sticks, blocks and weights. For example, a portion of the article 100 can be clamped or squashed by the rigid member prior to the delivery of the paint 30. After the delivery of the paint 30, and once the rigid member is removed and the compression is released, a pattern is revealed because the compression prevent some portions of the article 100 from being exposed to the paint 30.

For another example, exposing the area 110 can include covering at least a portion of the article 100 with a stencil that leaves the area 110 exposed. While any suitable stencil can be used, some suitable stencils include letter, word, and images stencils. For example, if it is desirable for a person's name to be painted onto the article 100, individual letter stencils, or a word stencil of the name, can be used to cover certain portions of the article 100, so that when the paint 30 is delivered, it is applied to the article 100 in the form of the letters or words. Or, for example, if it is desirable for a holiday image to be painted onto the article 100, a stencil of the image can be used to cover certain portions of the article 100, so that when the paint 30 is delivered, it is applied to the article 100 in the form of the image.

It should be understood that manipulation of the article 100, and using devices such as flexible and rigid members and stencils, can all be used individually, in the aggregate, and/or in combination with one another and with other exposure methods to achieve a variety of desired results.

In another aspect of the method of the invention, the method further includes maintaining the opening 75 of the nozzle 70 at a distance between 4 and 6 inches from the area 110. It should be understood that each of these ranges encompasses the limits of the stated range as well as each increment in between the limits as if recited specifically herein. Such a distance is preferred when the spray cone has a diameter between 5 and 7 inches at a distance of between 4 and 6 inches from the opening 75 of the nozzle 70. As discussed above with regard to the system of the invention, such a distance is particularly useful in the crafts industry.

In another aspect of the method of the invention, the method further includes, as the paint 30 is released, moving the opening 75 of the nozzle 70 in a motion proximal to the area 110. While as described above with regard to the system of the invention, the paint 30 is delivered uniformly, the motion according to this aspect of the method of the invention enhances the uniformity of the coverage. Further, a particular distance between the opening 75 of the nozzle 70 and the area 110 can be chosen and/or varied to affect how fast the paint 30 will be applied to the area 110. Further in this regard, the speed of the motion can additionally or alternatively be varied to also affect how fast the paint 30 will be applied to the area 110. While as described above with regard to the system of the invention, the paint 30 is delivered in a fine mist, choosing and/or varying the motion and/or proximity according to this aspect of the method of the invention can further enhance the ability to apply the as thinly or as thickly as desired. For example, a particular shade of a color can be produced beside another shade of the color smoothly and easily. If a sharp transition is desirable, the opening 75 of the nozzle 70 can be held away from the area 110 for a short time (producing a light shade) and then quickly moved close to a portion of the area 110 (producing a darker shade in that portion of the area 110), while the paint 30 is still being delivered. If a smoother transition is desired, the movement can be slowed. It should be understood that among other patterns, shade patterns can therefore be achieved, such as, for example, criss-cross patterns, dot patterns, stripe patterns, and the like. Further, it should be understood that multi-colored and mixed-colored patterns can also be achieved by this aspect of the method of the invention.

Although the invention herein has been described with reference to particular embodiments, it is to be understood that these embodiments are merely illustrative of the principles and applications of the invention. It is therefore to be understood that numerous modifications may be made to the illustrative embodiments and that other arrangements may be devised without departing from the spirit and scope of the invention as defined by the appended claims.

What is claimed is:

1. A fabric paint delivery system, comprising:

a) a container storing fabric paint under nitrogen pressure, the container having an opening for discharge of the paint therethrough;

b) a valve operative for receiving the paint from the opening;

c) a trigger assembly having a nozzle operative for discharging the paint received from the container through the valve, the trigger assembly having a trigger for opening and closing the valve to selectively discharge the paint from an opening of the nozzle as a mist in a spray cone wherein the spray cone has a diameter between 5 and 7 inches at between 4 to 6 inches from the opening of the nozzle of the trigger assembly; wherein d) the trigger is operable by pulling the trigger towards the container using one's index finger for opening the valve and for closing the valve by releasing the trigger.

2. The system of claim 1, wherein the spray cone has a diameter of 6 inches at 5 inches from the opening of the nozzle of the trigger assembly.

3. The system of claim 1, wherein the container has a longitudinal axis and the trigger is movable in a direction perpendicular to the longitudinal axis.

4. The system of claim 1, wherein the paint comprises an acrylic polymer.

5. The system of claim 1, wherein the paint is water-soluble.

6. The system of claim 1, wherein the paint comprises non-flammable and non-toxic components.

7. The system of claim 1, wherein the paint has a viscosity of between 2500 centipoises and 3500 centipoises.

8. The system of claim 7, wherein the paint has a viscosity of 2800 centipoises.

9. The system of claim 1, wherein the container holds up to 6 ounces of the paint.

10. The system of claim 1, wherein the pressure is between 130 psi and 140 psi.

* * * * *